US005715936A

United States Patent [19]

Focke et al.

[11] Patent Number: 5,715,936

[45] Date of Patent: Feb. 10, 1998

[54] HINGE-LID BOX FOR CIGARETTES OR THE LIKE

[75] Inventors: Heinz Focke, Verden; Henry Buse, Visselhövede, both of Germany

[73] Assignee: Focke & Co. (GmbH & Co.), Verden, Germany

[21] Appl. No.: 595,642

[22] Filed: Feb. 2, 1996

[30] Foreign Application Priority Data

Feb. 28, 1995 [DE] Germany ..... 195 06 844.0

[51] Int. Cl.[6] ..... B65D 85/10

[52] U.S. Cl. ..... 206/268; 206/273; 206/831

[58] Field of Search ..... 206/242, 259, 206/265, 268, 271, 273, 831, 232; 229/125.37, 160.1

[56] References Cited

U.S. PATENT DOCUMENTS

| | | | |
|---|---|---|---|
| 3,695,422 | 10/1972 | Tripodi | 206/831 |
| 4,620,664 | 11/1986 | Kaufman et al. . | |
| 5,035,935 | 7/1991 | Thomas et al. | 206/831 |
| 5,137,148 | 8/1992 | Evers | 206/831 |
| 5,160,024 | 11/1992 | Evers | 206/268 |
| 5,375,704 | 12/1994 | Focke et al. | 206/268 |
| 5,533,613 | 7/1996 | Minarelli et al. | 206/242 |

FOREIGN PATENT DOCUMENTS

| | | |
|---|---|---|
| 0476882A1 | 3/1992 | European Pat. Off. . |
| 2540221A1 | 9/1979 | Germany . |
| 3634489A1 | 4/1987 | Germany . |
| 3835385A1 | 4/1990 | Germany . |
| 4237523A1 | 5/1994 | Germany . |
| 2238770 | 6/1991 | United Kingdom . |

*Primary Examiner*—Paul T. Sewell
*Assistant Examiner*—Luan K. Bui
*Attorney, Agent, or Firm*—Abelman, Frayne & Schwab

[57] ABSTRACT

It is often required, in the case of hinge-lid boxes, to introduce enclosed leaflets or coupons (29) into the pack such that they can be seen at least when the pack is opened for the first time. A positionally correct arrangement of such a coupon (29) is ensured by a stop in the form of a lug (32) in the lower region of a collar front wall (16) of a collar (15). The coupon (29) is supported on said lug (32).

7 Claims, 4 Drawing Sheets

HINGE-LID BOX FOR CIGARETTES OR THE LIKE

BACKGROUND OF THE INVENTION

1. Field of the Invention

The invention relates to a hinge-lid box for a cigarette group or other consumer goods, having a box part, having a lid which is connected pivotably to said box part in the region of a box rear wall and of a lid rear wall, and having a collar which is fastened in the box part and projects out of the same with a sub-region, a collar front wall resting against the inner side of a box front wall.

2. Description of the Prior Art

Hinge-lid boxes—also called hinge-lid packs—are a type of packaging for cigarettes which is well-known throughout the world. However, hinge-lid boxes may also be used for other goods which are to be packaged. The design of this type of pack, consisting of thin cardboard, is standard throughout the world. A (lower) box part and a lid which is connected pivotably to said box part are made up of the same, single-piece blank. A collar may be connected to said blank, but is usually formed from a separate blank. The collar, comprising collar front wall and collar side tabs, is usually anchored to a lower region in the box part, such that the collar front wall rests against the inner side of the box front wall and the collar side tabs likewise rest against the inner side of the box side walls.

SUMMARY OF THE INVENTION

It is increasingly the case that separate (loose) blanks, in particular coupons with advertisements, explanatory information or vouchers, are added to such hinge-lid boxes. It is important to provide such coupons in a position which is expedient when the hinge-lid box is opened for the first time, in order that the coupon can be easily seen and can be removed from the hinge-lid box without difficulty. It is this with which the invention is concerned.

The object of the invention is to design the hinge-lid box, and to position a coupon in the hinge-lid box, such that, on the one hand, satisfactory mechanical production of the hinge-lid box with the introduction of the coupon is possible and, on the other hand, favourable positioning and easy removal of the coupon are ensured.

In order to achieve this object, the hinge-lid box according to the invention is characterized in that, in the region of the box front wall, a separate blank is arranged within the hinge-lid box, in particular a coupon, advertising medium or the like, which is supported, by means of a preferably lower, transversely directed supporting edge, of at least one stop, in particular on the inner side of the collar or on the collar front wall.

The configuration according to the invention the hinge-lid box makes it possible to position a coupon or the like, comprising a separate blank, in a precise relative position within the pack without using glue.

The collar is designed in the conventional manner, namely with a cutout in the upper region of the collar front wall and with a correspondingly configured, downwardly directed extension. According to the invention, the stop, in particular a lug, is provided in the region of said extension, which is conventional in such collars.

The invention further relates to the mechanical introduction of the blank or coupon into the pack. This operation is integrated in the conventional packaging operation, in particular using the technology which can be found in U.S. Pat. No. 4,084,393.

In accordance with the recommendations of the invention, the coupon may be arranged in different ways in the upper (lid) region of the hinge-lid box, namely with a leg in the region of an upper end wall of the lid or in the region of the front side of the collar front wall. According to the invention, the coupon may be dimensioned such that a visible end projects out of the hinge-lid box in the region between the lid and box part.

Further features of the invention relate to the configuration of the hinge-lid box with coupon and to the method of, and apparatus for, providing the same in the pack.

BRIEF DESCRIPTION OF THE DRAWINGS

Exemplary embodiments therefore are explained in more detail hereinbelow with reference to the drawings, in which.

DESCRIPTION OF THE PREFERRED EMBODIMENTS

Figure 1:
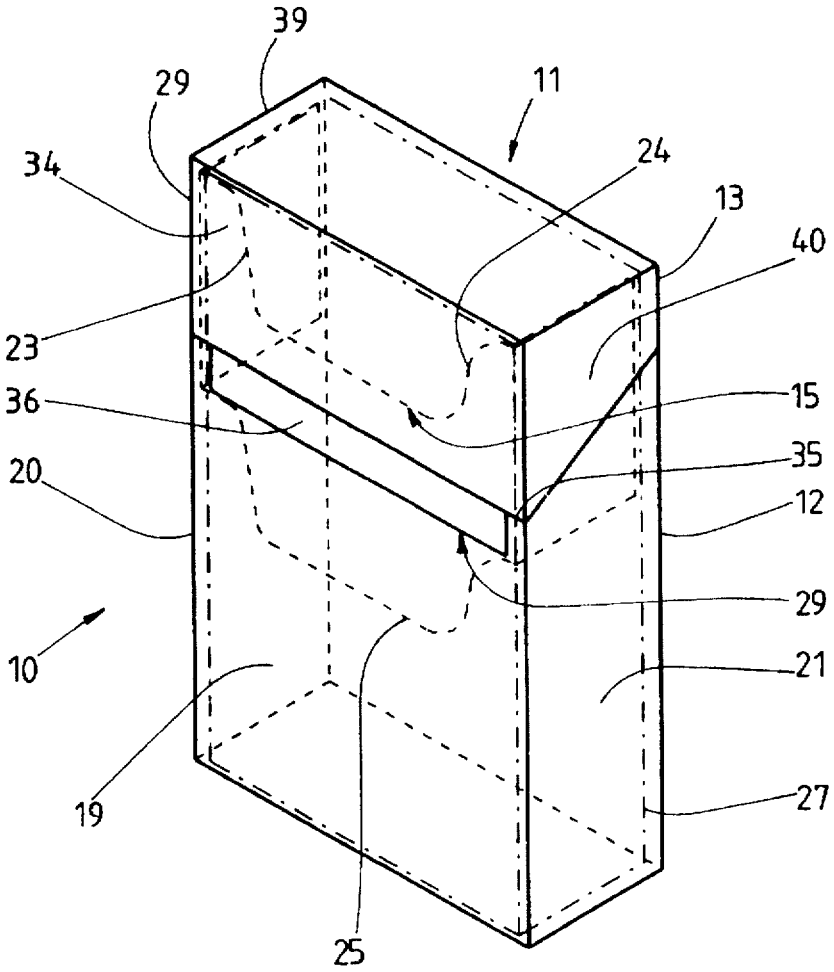
FIG. 1 shows a perspective view of a hinge-lid box in the closed position.
Figure 3:
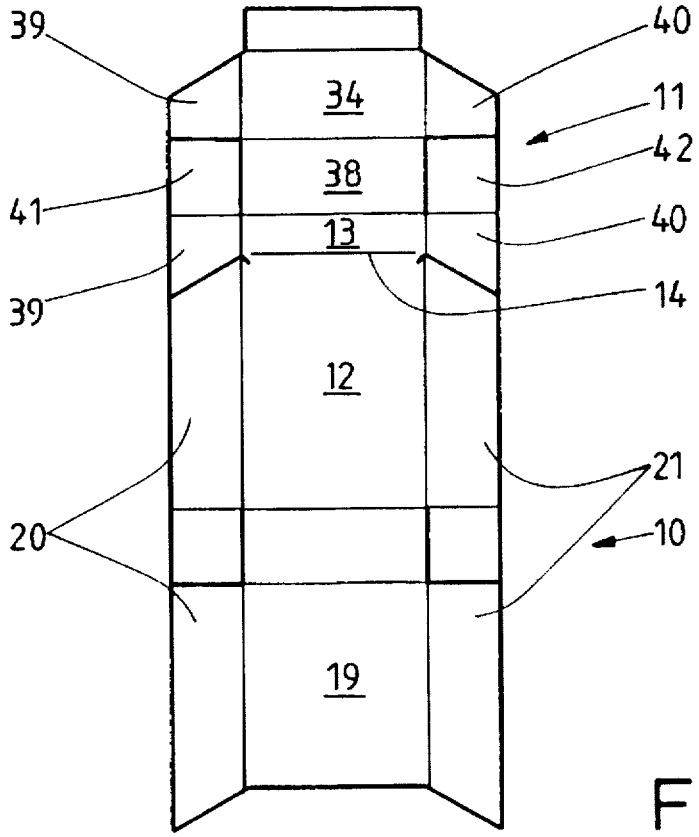
FIG. 3 shows a blank for the hinge-lid box, likewise spread out.

The hinge-lid box shown in perspective in FIG. 1 corresponds to the conventional design of this type of pack. A box part 10 and a lid 11 are connected to one another along a pivot line 14 in the region of a box rear wall 12 and of a lid rear wall 13 (FIG. 3). The box part 10 and lid 11 are made up of a single-piece blank (FIG. 3), usually of thin cardboard.

Figure 2:
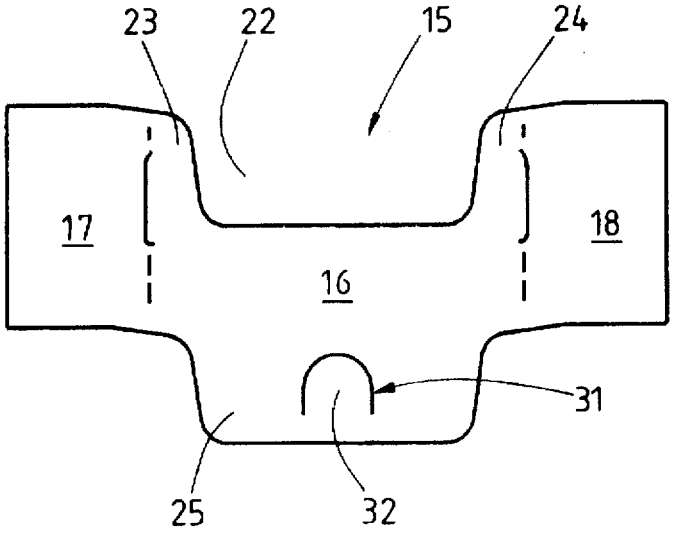
FIG. 2 shows a blank for a collar in the spread-out state.

Located within the hinge-lid box is a collar 15 which, here, is likewise formed from a separate blank (FIG. 2) of thin cardboard. The conventionally designed collar 15 comprises a collar front wall 16 and collar side tab 17, 18. The collar 15 is anchored in the box part 10, for example, by adhesive bonding, to be precise such that an upper sub-region of the collar 15 projects out of the box part. Said free part of the collar 15 is enclosed by the lid 11 when the hinge-lid box is in the closed position. The collar 15 is arranged such that the collar front wall 16 rests against the inner side of a box front wall 19. The two collar side tabs 17, 18 face the inner side of the box side walls 20 and 21.

The collar 15 is—as is usually the case—of a special geometrical configuration. At the top, the collar front wall 16 forms, in the central region, a cutout 22 which is delimited by webs 23, 24. Corresponding to this, the bottom of the collar front wall 16 is provided with an extension 25, the shape and size of which corresponds to the cutout 22. The extension 25 rests against the inner side of the box front wall 19.

Figure 4:
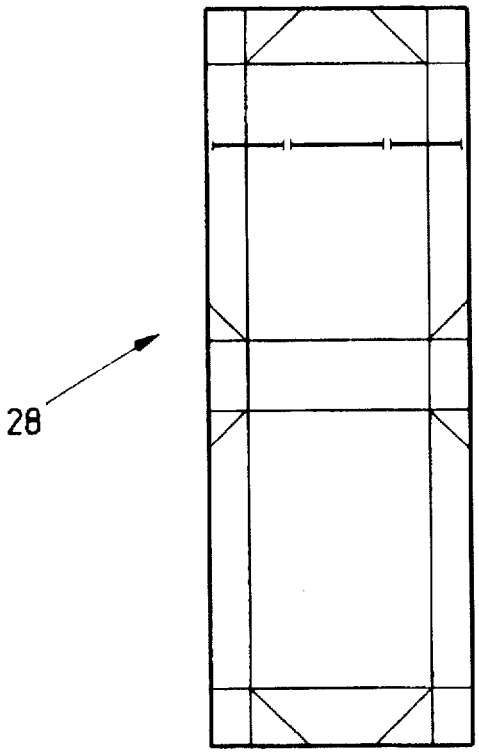
FIG. 4 shows a spread-out blank for an inner wrapper.

In the case of the pack of cigarettes 26, a cigarette group 27 forms the pack contents. Said contents are enclosed by an inner wrapper 28 of paper or tin foil. A blank of the inner wrapper 28 is shown in FIG. 4. The. cigarette group 27 is fully enclosed by the inner wrapper 28, to be precise folds being formed in the region of side surfaces and an end surface. For reasons of simplicity, the inner wrapper 28 is not shown in FIGS. 5 and 6.

A coupon 29 made up of a separate blank is arranged within the hinge-lid box or hinge-lid pack designed in this way. Said coupon is usually made of paper and serves as a printing medium for advertisements, information, etc. In the present exemplary embodiment, the coupon 29 is designed as a rectangular blank. It is arranged within the hinge-lid box, to be precise in the region between the collar 15 or collar front wall 16 on the one hand, and pack contents, namely cigarette group 27 or inner wrapper 28, on the other hand. The coupon 29 extends exclusively in the upper region, namely in an upper sub-region of the box part 10 and within the lid 11, when the pack is closed.

For the purpose of precise positioning, a lower transverse border 30 of the coupon 29 is supported on a stop formed within the pack. In the exemplary embodiment shown, said stop is located on the inner side of the collar 15, namely of the collar front wall 16. By virtue of the coupon 29 resting, or being supported, against the stop, the coupon achieves the desired, precise relative position within the pack. In addition, the coupon 29 remains in this precise position during transportation and storage, that is to say until the pack is opened for the first time.

In the present exemplary embodiment, the stop for the coupon 29 is formed in the lower region of the collar front wall 16, namely in the region of the extension 25. The latter is provided with a U-shaped, downwardly open punch cut 31. This thus produces an upwardly directed lug 32. Upon production of the pack and/or of the blanks for the collar 15, said lug is deformed slightly, with the result that the lug 32 projects into the interior of the pack, or in any case projects beyond the inner surface of the collar front wall 16.

The lug 32 serves as a stop for positioning the coupon 29. In the present case, said coupon enters, by means of a lower region, into a groove formed by the deformed lug 32, and is fixed here. In this arrangement, the lower transverse border 30 is supported on the lug 32.

The coupon 29 may be of different dimensions, but its dimensions should at least be such that an upper region extends within the cutout 22 and can therefore be seen when the hinge-lid box is opened.

Figure 5:
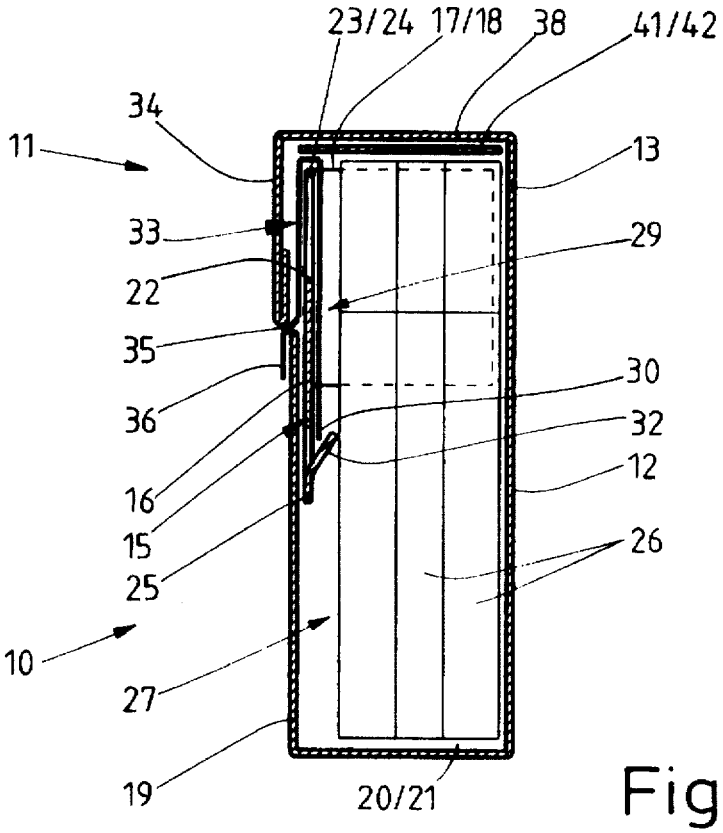
FIG. 5 shows a vertical section through a closed hinge-lid box.
Figure 6:
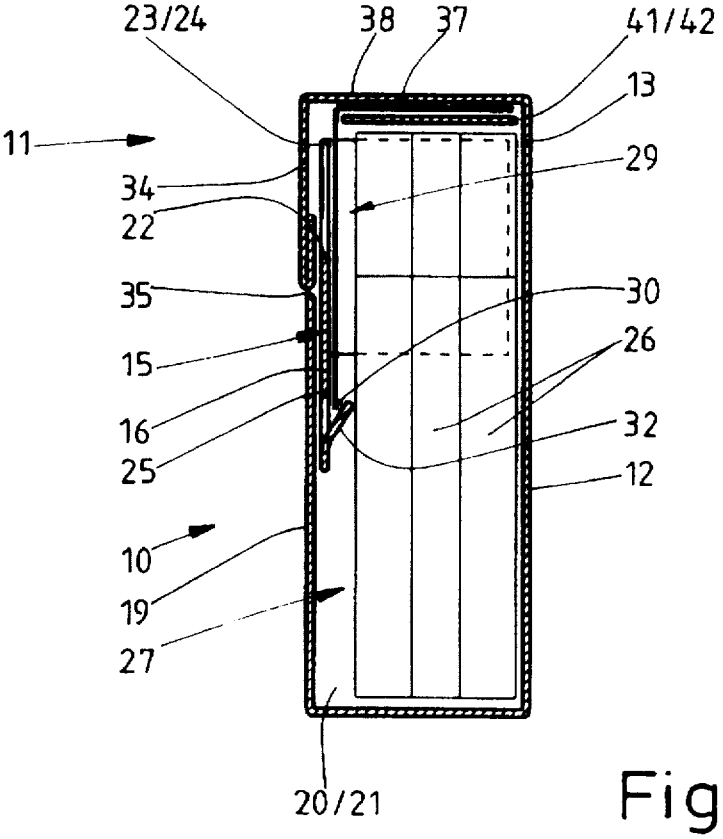
FIG. 6 shows a representation, corresponding to FIG. 5, for another exemplary embodiment.

FIGS. 5 and 6 show examples for particularly advantageous positioning of the coupon 29. In the arrangement according to FIG. 5, the coupon 29 is folded over outwards in the region of the collar front wall 16, with the result that a leg 33 of the coupon rests against the outer side of the collar front wall 16. In this arrangement, the coupon 29 is folded over the upper boundary of the Collar 15, namely over the upper ends of the webs 23, 24. When the lid 11 is opened, the leg 33 is immediately exposed. The coupon 29 can thus be easily grasped and pulled out.

On account of corresponding dimensioning of the coupon 29, the leg 33 extends into the region of a closure gap 35 formed between a lid front wall 34 and the box front wall 19. The coupon emerges from the hinge-lid box at said gap. A sub-region of the coupon 29 or of the leg 33 is located outside the hinge-lid box, namely on the outer side of the box front wall 19. A visible strip 36, which has been formed in this way, of the coupon 29 can thus be seen from the outside even when the pack is closed, to be precise even before the pack has been opened for the first time, if the pack is enclosed by an outer wrapper of clear film.

In the embodiment according to FIG. 6, the coupon 29 is likewise provided with an extension, namely a transverse leg 37. The latter extends within the hinge-lid box, to be precise in the region of an end wall 38 of the lid 11. The transverse leg 37 rests against the inner side of the end wall 38. Lid corner tabs 41, 42 connected to lid side walls 39, 40 are folded against the coupon or against the transverse leg 37, with the result that, in this region, the coupon is positioned between parts of the hinge-lid box, namely between the end wall 38 and lid corner tabs 41, 42.

Figure 7:
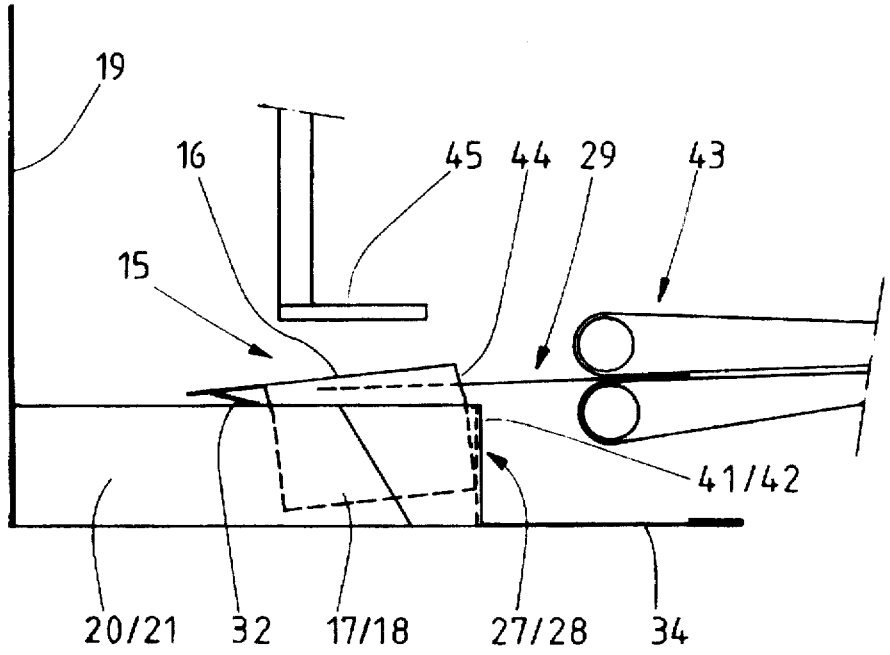
FIG. 7 shows a side view of a detail of an apparatus during introduction of the blank/coupon into a hinge-lid box.
Figure 8:
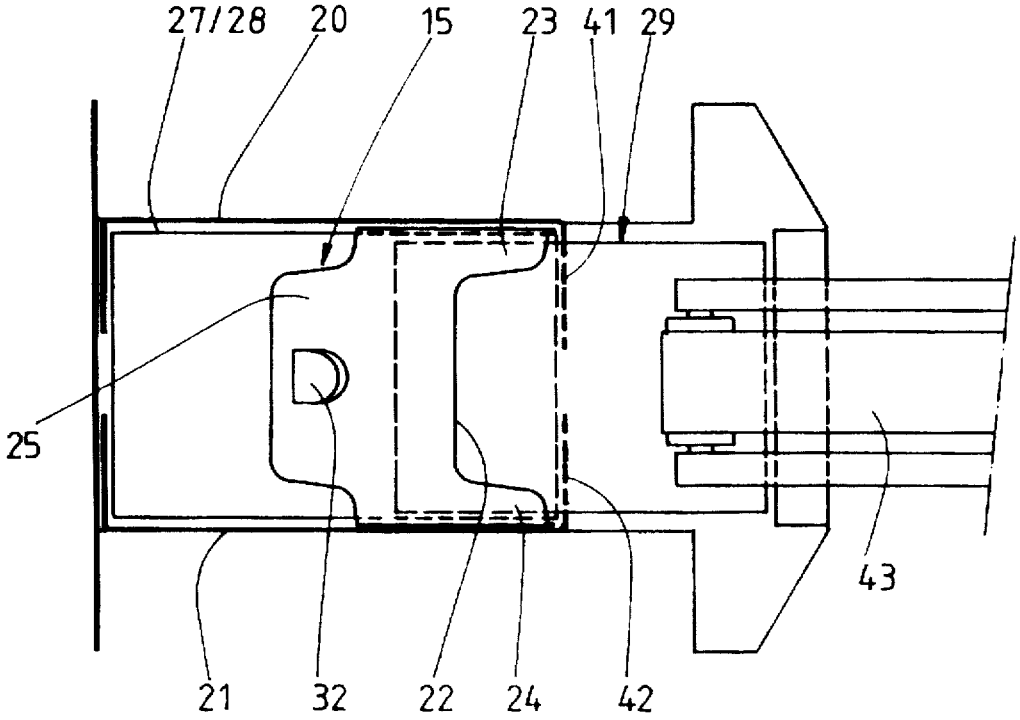
FIG. 8 shows a plan view of the detail according to FIG. 7.

An advantageous proposal for introducing the coupon 29 into the partially folded hinge-lid box is given in FIGS. 7 and 8. The blank (FIG. 3) for the hinge-lid box is partially folded, namely in an L-shaped form. This corresponds to an intermediate folding position within a folding turret (not shown) rotating about a vertical axis. This folding process is given in U.S. Pat. No. 4 084 393.

The pack contents, namely the cigarette group 27 enclosed by an inner wrapper 28, have already been introduced into the pack, open at the top and in the region of the end wall 38, and have been positioned therein. The wrapped cigarette group 27 has been moved into this position with the collar 15 folded in the form of a U.

As can be seen from FIG. 7, the collar 15, provided with the lug 32, is raised slightly, in the region of the collar front wall 16, into a funnel-like oblique position. It is then possible, via the radially outer side, for the coupon 29 to be pushed, by a conveying member 43 with two conveying belts, into a gap 44, formed between the collar front wall 16 and (wrapped) cigarette group 27, until it rests against the lug 32. The collar 15 or the collar front wall 16 is then moved downwards, by a ram 45 which can be lowered from above, into the correct position within the pack, in which it rests against the pack contents. The packaging process may then be continued in the usual manner.

Upon introduction into the gap 44, the blank is conveyed until it rests against the stop, namely the lug 32. Thereafter, the coupon 29 can either be folded outwards and upwards, as in FIG. 5, or into the plane of the end wall 38 by means of a transverse leg 37, as in FIG. 6.

We claim:

1. Hinge-lid box having a lower box part (10) comprised of a rear wall (12), front wall (19), side walls (20, 21) and a bottom wall, having a lid (11) comprised of a lid rear wall (13), a lid front wall (34), end wall (38) and lid side walls (39, 40), the lid (11) being pivotally connected to the rear wall (12) of the box part (10) in the region of the lid rear wall (13), and including:

a) a collar (15) which has at least one collar front wall (16) is fastened in the box part, b) the collar front wall (16) rests against the inside of the front wall (19) and projects from the front wall (19) with an upper part region, this upper part region resting against the inside of the lid front wall (34) when the lid (11) is closed, c) the collar front wall (16) extends adjacent to a part region of the front wall (19) with a lower part region, d) the collar front wall (16) is provided with a stop (31, 32), said stop (31, 32) located in the region of the lower part region of the collar front wall (16), e) in the region of the front wall (19), inside the hinge-lid box, there is arranged a separate blank, namely a coupon (29), f) the coupon (29) is provided with a first leg with a continuous lower transverse edge (30) and rests against the collar front wall (16) with said first leg, g) the coupon (29), with its lower transverse edge (30), rests against the stop (31, 32) and extends upwardly from said stop (31, 32), in the direction of the end wall (38), h) the top of the first leg is adjoined by a second leg (33, 37) which is angled relative to said first leg and held in the hinge-lid box between walls or wall parts.

2. Hinge-lid box according to claim 1, wherein the stop (31, 32) is directed towards the inside of the hinge-lid box such that the coupon (29) with its first leg rests against that side of the collar front wall (16) that is facing away from the front wall (19).

3. Hinge-lid box according to claim 1, wherein the stop for the coupon (29) is formed by an inwardly directed deformation of the collar front wall (16), by a lug (32) which is formed by a punch cut (31) in the collar front wall (16), the punch cut having the shape of a U standing upside down and the upper region of the surface surrounded by the punch cut is pressed out of the plane of the collar front wall (16).

4. Hinge-lid box according to claim 1, wherein the stop (31, 32) is formed in the region of a lower extension (25) of the collar front wall (16), the extension (25) corresponding in shape and size to an upper cutout (22) of the collar front wall (16).

5. Hinge-lid box according to claim 3, wherein the coupon (29) enters, by means of continuous lower transverse edge (30), into a groove formed between the lug (12) and collar front wall (16).

6. Hinge-lid box according to claim 1, wherein the second leg (33) is folded around the collar front wall (16) from its inside outwards and downwards and rests against at least the upper part region of the collar front wall (16).

7. Hinge-lid box according to claim 1, wherein the second leg (37) of the coupon (29) extends within the lid (11), adjacent to the upper end wall (38) of the lid, the second leg (37) being positioned between the end wall (38) and the lid corner tabs (41, 42) which are folded into the plane of the end wall.

* * * * *